US005651351A

United States Patent [19]

Matsumoto et al.

[11] Patent Number: 5,651,351

[45] Date of Patent: Jul. 29, 1997

[54] FAULT DIAGNOSIS APPARATUS FOR A FUEL EVAPORATIVE EMISSION SUPRESSING SYSTEM

[75] Inventors: Takuya Matsumoto; Toru Hashimoto; Mitsuhiro Miyake; Hitoshi Kamura; Yasuhisa Yoshida, all of Tokyo, Japan

[73] Assignee: Mitsubishi Jidosha Kogyo Kabushiki Kaisha, Tokyo, Japan

[21] Appl. No.: 647,966

[22] PCT Filed: Sep. 28, 1995

[86] PCT No.: PCT/JP95/01972

§ 371 Date: Aug. 1, 1996

§ 102(e) Date: Aug. 1, 1996

[87] PCT Pub. No.: WO96/10691

PCT Pub. Date: Apr. 11, 1996

[30] Foreign Application Priority Data

Sep. 30, 1994 [JP] Japan ..... 6-237428

[51] Int. Cl.[6] ..... F02M 25/08

[52] U.S. Cl. ..... 123/520

[58] Field of Search ..... 123/518, 519, 123/520, 198 D, 339.15; 364/431.11

[56] References Cited

U.S. PATENT DOCUMENTS

| | | | |
|---|---|---|---|
| 5,216,991 | 6/1993 | Iida et al. | 123/520 |
| 5,315,980 | 5/1994 | Otsuka et al. . | |
| 5,351,193 | 9/1994 | Poirier et al. | 123/520 |
| 5,520,160 | 5/1996 | Aota et al. | 123/520 |
| 5,535,719 | 7/1996 | Morikawa et al. | 123/520 |
| 5,559,706 | 9/1996 | Fujita | 123/520 |

FOREIGN PATENT DOCUMENTS

| | | |
|---|---|---|
| 233442 | 2/1990 | Japan . |
| 4311663 | 11/1992 | Japan . |
| 658212 | 3/1994 | Japan . |
| 7119557 | 5/1995 | Japan . |

*Primary Examiner*—Thomas N. Moulis

[57] ABSTRACT

A fault diagnosis apparatus for detecting a fault in a fuel evaporative emission suppressing system, if it is concluded that an engine (1) is being operated in an operating state fulfilling fault diagnosis execution conditions, detects the current valve opening position of an idling speed control (ISC) valve (8) and then drives a purge control valve (46) to open the same. If a relatively high load is applied to the engine at this time, the threshold value determining the operating sensitivity of the ISC valve is so corrected as to be decreased. When a predetermined period of time has elapsed from the moment when the valve opening position of the ISC valve is detected, the valve opening position of the ISC valve is detected again. If the deviation between these valve opening positions is not larger than the threshold value, it is concluded that the purge air introduction by the drive of the purge control valve is not performed, that is, it is concluded that the valve is faulty. Since the operating sensitivity of the ISC valve increases as an engine load increases, erroneous diagnosis is prevented.

14 Claims, 13 Drawing Sheets

FAULT DIAGNOSIS APPARATUS FOR A FUEL EVAPORATIVE EMISSION SUPRESSING SYSTEM

TECHNICAL FIELD

The present invention relates to a fault diagnosis apparatus for a fuel evaporative emission suppressing system.

BACKGROUND ART

In order to prevent air pollution and the like, the engine and body of an automobile are provided with various devices for treating harmful emission components. These known devices include, for example, a blow-by gas recirculating device for guiding a blow-by gas, which consists mainly of an unburned fuel component (HC) leaking from a combustion chamber of the engine into a crank case, to an intake pipe, and a fuel evaporative emission suppressing device for guiding a fuel evaporative gas, composed mainly of HC produced in a fuel tank, into the intake pipe.

The fuel evaporative emission suppressing device comprises a canister, loaded with activated charcoal which adsorbs the fuel evaporative gas, various pipes, etc. The canister is provided with an inlet port communicating with the fuel tank, an outlet port communicating with the intake pipe, and a vent port which opens to the atmosphere. In the fuel evaporative emission suppressing device of this canister-storage type, the fuel evaporative gas in the fuel tank is introduced into the canister and adsorbed by the activated charcoal. The atmospheric air (purge air) is introduced into the canister through the vent port by applying a negative pressure in the intake pipe to the outlet port. The fuel evaporative gas adsorbed by the activated charcoal is separated therefrom by means of the purge air, and introduced into the intake pipe along with the purge air. The fuel evaporative gas, thus delivered into the intake pipe, is burned in the combustion chamber of the engine together with an air-fuel mixture, whereby it is prevented from being discharged into the atmosphere.

If the purge air containing the fuel evaporative gas is introduced carelessly into the intake pipe, however, the air-fuel ratio of an air-fuel mixture deviates from its appropriate range, so that the rotational speed and output torque of the engine fluctuate greatly. Accordingly, the comfortableness to drive or drivability of the vehicle worsens. This unfavorable phenomenon is particularly remarkable in the case where the purge air is introduced while the engine is running in an idling speed area in which the quantity of intake air is small.

To avoid this, a purge control valve, for use as purge regulating means for controlling the rate of purge air introduction, is provided in a purge passage which connects the canister and the intake pipe. The purge control valve is opened to allow the purge air to be introduced into the engine only when the engine is operating in a predetermined operation area. In general, purge control valves may be classified into two types, mechanical ones which operate in response to negative intake pressure and electrical ones which are controlled in on-off operation by means of an electronic control unit (ECU) in accordance with pieces of operation information, such as the throttle opening, intake air flow rate, etc. Although the mechanical valves, being low-priced, are widely used, the electrical or solenoid-operated valves are superior in performance, since the introduction and shut-off of the purge air can be controlled more accurately and freely by the electrical ones.

In the fuel evaporative emission suppressing device furnished with such a solenoid-operated purge control valve, however, snapping of wires which connect the ECU and the purge control valve, connector contact failure, etc. may occur, or a valve plug in the control valve may possibly be fixed in a closed state from some cause. In such a case, the purge air cannot be introduced into the intake pipe, so that the canister is overloaded with the fuel evaporative gas. Inevitably, therefore, the fuel evaporative gas additionally supplied from the fuel tank is discharged into the atmosphere without being adsorbed by the activated charcoal.

However, the discharge of the fuel evaporative gas into the atmosphere constitutes no hindrance to the engine operation. Thus, a driver is not aware of this fault as the fuel evaporative gas continues to be discharged into the atmosphere.

A method of making the fault diagnosis of purge control has been proposed in Unexamined Japanese Patent Publication No. H3-286163, etc. With this proposed method, the purge control valve is driven to open during the idling operation of an engine equipped with an idle speed controller (the ISC), and fault diagnosis is made on the basis of the operation state of ISC. When the purge control valve is driven to open during idling operation, purge air is introduced if the purge control valve is normal, whereby the ISC is operated to prevent an increase in engine rotational speed due to the introduction of purge air. On the other hand, if the purge control valve is faulty, purge air is not introduced, so that the ISC is not operated. If the ISC is not operated when the purge control valve is driven to open, the purge control valve is judged to be faulty.

However, the proposed method has a disadvantage in that it can cause erroneous diagnosis. That is to say, in an order to prevent hunting in ISC operation, which occurs when the ISC is operated so as to compensate even a small change in engine rotational speed caused by the variations in fuel condition between engine cylinders or caused by the light load applied to the engine, the ISC is generally operated only when the engine speed deviates from a predetermined range including the target of idling speed during the idling operation. During idling operation, if a running range is selected in an automatic transmission or if a cooler compressor is operated, a relatively heavy load is applied to the engine. At this time, a large quantity of intake air necessary for keeping the engine speed within the predetermined range is supplied. Accordingly, even when purge air is introduced, the increase rate of the quantity of intake air is low, and the rise in engine speed such that the engine speed deviates from the predetermined range does not occur, so that the ISC does not operate. That is to say, in the case where a relatively heavy load is applied to the engine, even if the purge control valve is normal and the purge air for fault diagnosis is introduced normally, the purge control valve is sometimes erroneously judged to be faulty.

DISCLOSURE OF THE INVENTION

An object of the present invention is to provide a fault diagnosis apparatus capable of preventing erroneous diagnosis, in particular, the erroneous diagnosis caused by increased engine load, of a fuel evaporative emission suppressing system attached to a vehicular engine.

To achieve the above object, according to one aspect of the present invention, there is provided a fault diagnosis apparatus for detecting a fault in a fuel evaporative emission suppressing system attached to an engine mounted on a vehicle. The suppressing system includes a purge passage, through which a fuel evaporative gas in a fuel supply system of the engine, along with outside air, is introduced as purge air into an intake passage of the engine, and purge regulating means for changing a quantity of purge air introduction. The fault diagnosis apparatus comprises operating state detecting means for detecting an operating state of at least one of the vehicle, the engine, and means associated with engine operation; diagnosis means for making a diagnosis to detect the occurrence of a fault in the fuel evaporative emission suppressing system, if a quantity of change of the at least one operating state, which is observed when the purge regulating means is driven to introduce the purge air, is smaller than a fault discrimination value; and correcting means for correcting the fault discrimination value according to the at least one operating state detected by the operating state detecting means.

An advantage of the present invention is that a fault discrimination value is corrected according to an operating state of at least one of the vehicle, the engine, and means associated with engine operation, thereby preventing erroneous diagnosis, especially erroneous diagnosis prone to occur when a relatively high load is applied to the engine. Specifically, when the purge regulating means is driven, purge air is introduced if the fuel evaporative emission suppressing system is normal. With this purge air introduction, an operating state (for example, engine speed) of at least one of the vehicle, the engine, and means associated with engine operation changes relatively greatly. If a relatively high load is applied to the engine during the fault diagnosis, the intake air quantity increases, so that the change of operating state caused by purge air introduction is relatively small. On the other hand, the fault discrimination value has been corrected before the purge air introduction. In consequence, the quantity of change of operating state exceeds the corrected fault discrimination value. Thus, if the suppressing system is normal, the quantity of change of operating state observed when the purge regulating means is operated exceeds the fault discrimination value, so that the diagnosis means properly judges that the suppressing system is normal. That is to say, erroneous diagnosis is prevented even when the engine load is high. If the suppressing system is faulty, no purge air is introduced, so that the at least one operating state does not change. In this case, since the quantity of change of operating state is smaller than the fault discrimination value, the diagnosis means judges that the suppressing system is faulty.

The fault diagnosis apparatus is sometimes provided in the fuel evaporative emission suppressing system attached to the engine which has, in the intake passage thereof, intake air quantity regulating means for adjusting a quantity of air sucked into the engine, thereby keeping an engine speed constant. In this case, preferably, the correcting means corrects the fault discrimination value in a direction to decrease the same when an increase in manipulated variable of the intake air quantity regulating means is detected by the operating state detecting means.

An advantage of this preferred embodiment is that the fault discrimination value is corrected to decrease in accordance with an increase in manipulated variable of the intake air quantity regulating means, thereby preventing erroneous diagnosis prone to occur when a relatively high load such as to increase the manipulated variable of the intake air quantity regulating means is applied to the engine. Specifically, when an increase in manipulated variable of the intake air quantity regulating means is detected by the operating state detecting means, the correcting means corrects the fault discrimination value in a direction to decrease the same. If the fuel evaporative emission suppressing system is normal, a quantity of change of the at least one operating state, attributable to the purge air introduction by the drive of the purge regulating means, is relatively small, but the quantity of change of operating state exceeds the corrected fault discrimination value. Therefore, the diagnosis means properly judges that the suppressing system is normal.

Preferably, the operating state detecting means detects a gearshift range of an automatic transmission mounted on the vehicle, and detects the increase in manipulated variable of the intake air quantity regulating means when the gearshift range is in a running range. In this preferred embodiment, when the gearshift range is in a running range, the increase in manipulated variable of the intake air quantity regulating means is detected by the operating state detecting means. In this case, the correcting means corrects the fault discrimination value in a direction to decrease the same, whereby erroneous diagnosis prone to occur when the gearshift range is in a running range is prevented.

Alternatively, the operating state detecting means detects an operation of an engine-driven compressor for an air conditioner mounted on the vehicle, and detects the increase in manipulated variable of the intake air quantity regulating means when the compressor is operated. In this preferred embodiment, when the compressor is operated, the increase in manipulated variable of the intake air quantity regulating means is detected by the operating state detecting means. In this case, the correcting means corrects the fault discrimination value in a direction to decrease the same, whereby erroneous diagnosis prone to occur when the compressor is operated is prevented.

Preferably, the operating state detecting means detects an air-fuel ratio of a mixture supplied to the engine as the at least one operating state. In this preferred embodiment, based on a phenomenon that the air-fuel ratio of the mixture changes when purge air which is richer or leaner than the theoretical air-fuel ratio (the air-fuel ratio of purge air changes depending on the quantity of adsorbed fuel evaporative gas in the fuel evaporative emission suppressing system) is introduced, the fault diagnosis of the fuel evaporative emission suppressing system is made on the basis of the quantity of change in air-fuel ratio of mixture, attributable to the drive of the purge regulating means. In the fault diagnosis apparatus which is provided in the fuel evaporative emission suppressing system attached to the engine having an air-fuel ratio controlling means for feedback-controlling the air-fuel ratio to a predetermined value, the operating state detecting means preferably detects the air-fuel ratio of mixture when the air-fuel ratio is feedback-controlled by the air-fuel ratio controlling means, as the at least one operating state. During the feedback control of the air-fuel ratio, the air-fuel ratio of mixture takes a predetermined value or a value in the vicinity of the predetermined value. Therefore, the quantity of change in air-fuel ratio, attributable to the drive of the purge regulating means, properly represents the presence/absence of a fault in the suppressing system.

Alternatively, the operating state detecting means detects an engine speed as the at least one operating state. In this preferred embodiment, based on a phenomenon that the engine speed increases when purge air is introduced, the fault diagnosis of the fuel evaporative emission suppressing system is made on the basis of the quantity of change in engine speed, attributable to the drive of the purge regulating means. In the fault diagnosis apparatus which is provided in the fuel evaporative emission suppressing system attached to the engine which has, in the intake passage thereof, intake air quantity regulating means for adjusting a quantity of air sucked into the engine, thereby keeping an engine speed constant, the operation of the intake air quantity regulating means is preferably prohibited during fault diagnosis. In this case, the engine speed is not controlled by the operation of the intake air quantity regulating means. Therefore, the quantity of change in air-fuel ratio, attributable to the drive of the purge regulating means, properly represents the presence/absence of fault of suppressing system.

Further preferably, the operating state detecting means detects both of the air-fuel ratio of mixture and the engine speed as the at least one operating state. In the fault diagnosis apparatus which is provided in the fuel evaporative emission suppressing system attached to the engine which has, in the intake passage thereof, intake air quantity regulating means for adjusting a quantity of air sucked into the engine, thereby keeping an engine speed constant, the operating state detecting means preferably detects both of the air-fuel ratio of mixture and the engine speed or both of the air-fuel ratio of mixture and the manipulated variable of the intake air quantity regulating means as the at least one operating state.

An advantage of this preferred embodiment is that erroneous diagnosis prone to occur when purge air of substantially theoretical air-fuel ratio is introduced during the time when the air-fuel ratio of mixture is feedback-controlled to the theoretical air-fuel ratio by the air-fuel ratio controlling means can be prevented. Specifically, when purge air of substantially theoretical air-fuel ratio is introduced during the feedback control of air-fuel ratio, the air-fuel ratio of the whole of mixture and purge air becomes almost equal to the theoretical air-fuel ratio before and after the purge air introduction, and the air-fuel ratio of mixture is unchanged. Therefore, erroneous diagnosis is prone to occur when fault diagnosis is made on the basis of only the quantity of change in air-fuel ratio of mixture, attributable to the drive of the purge regulating means. In this preferred embodiment, fault diagnosis on the basis of the quantity of change in engine speed or the quantity of change in manipulated variable of intake air quantity regulating means is also made, to thereby obviate such erroneous diagnosis.

According to another aspect of the present invention, there is provided a fault diagnosis apparatus for detecting a fault in the fuel evaporative emission suppressing system attached to the engine mounted on a vehicle. The engine has an intake air quantity regulating means operating so that an engine speed approaches a target speed by regulating a quantity of air sucked in the engine via an intake passage of the engine when a deviation between the engine speed and the target speed exceeds a predetermined threshold value. Also, the fuel evaporative emission suppressing system includes a purge passage, through which a fuel evaporative gas in a fuel supply system of the engine, along with outside air, is introduced as purge air into the intake passage of the engine, and purge regulating means for changing a quantity of purge air introduction.

The fault diagnosis apparatus of the present invention comprises operating state detecting means for detecting an operating state of at least one of the vehicle, the engine, and means associated with engine operation; manipulated variable detecting means for detecting a manipulated variable of the intake air quantity regulating means; diagnosis means for making a fault diagnosis on the fuel evaporative emission suppressing system based on a change in manipulated variable of the intake air quantity regulating means observed when the purge regulating means is operated so as to introduce purge air; and correcting means for correcting the predetermined threshold value in a direction to decrease the same when the operating state detecting means detects, during the time when the diagnosis means is making diagnosis, a load that causes an intake air quantity to increase, is being applied to the engine.

In the present invention, unless a relatively high load, increases the intake air quantity, is applied to the engine during fault diagnosis, the predetermined threshold value is not so corrected as to be decreased, and a relatively large threshold value is set. When the purge regulating means is driven, purge air is introduced and the engine speed increases relatively greatly if the fuel evaporative emission suppressing system is normal, so that the deviation between the engine speed and the target speed exceeds the relatively large threshold value. Accordingly, the intake air quantity regulating means operates so that the engine speed approaches the target speed. That is to say, the manipulated variable of the intake air quantity regulating means changes relatively greatly. In this case, the diagnosis means judges that the suppressing system is not faulty. Since the threshold value is relatively large, the deviation between the engine speed and the target speed less frequently exceeds the threshold value due to the subsequent change in engine speed. Therefore, hunting in the operation of the intake air quantity regulating means can be prevented.

If a relatively high load, that increases the intake air quantity, is applied to the engine, the correcting means corrects the predetermined threshold value in a direction to decrease the same. Since the high engine load increases the intake air quantity, the increase in engine speed due to the purge air introduction is relatively small. However, since a relatively small threshold value is set, the deviation between the engine speed and the target speed exceeds the threshold value, so that the intake air quantity regulating means is operated. Thereupon, the diagnosis means properly judges that the suppressing system is normal. That is to say, an erroneous diagnosis caused by the increase in engine load is prevented.

On the other hand, if the suppressing system is faulty, no purge air is introduced, the manipulated variable of the intake air quantity regulating means is unchanged. In this case, the diagnosis means judges that the suppressing system is faulty.

An advantage of the present invention is that the presence/absence of a fault in the fuel evaporative emission suppressing system can be detected reliably based on the presence/absence of a change in manipulated variable of the intake air quantity regulating means even when the engine speed is kept constant by the operation of the intake air quantity regulating means. Another advantage of the present invention is that when a load that increases the intake air quantity is applied to the engine during fault diagnosis, the predetermined threshold value is corrected by being decreased to facilitate the operation of the intake air quantity regulating means. Accordingly, even when a relatively high load is applied to the engine during fault diagnosis, the intake air quantity regulating means responds reliably to a relatively small increase in engine speed, attributable to the purge air introduction. Therefore, erroneous diagnosis judging that the fuel evaporative emission suppressing system is faulty can be prevented.

Preferably, the operating state detecting means detects a gearshift range of an automatic transmission mounted on the vehicle. Also, when the operating state detecting means judges that the gearshift range of the automatic transmission is in a running range, the correcting means corrects the predetermined threshold value in a direction to decrease the same. In this preferred embodiment, when a running range is selected in the automatic transmission and a relatively high load is applied to the engine during fault diagnosis, the predetermined threshold value is corrected by being decreased to facilitate the operation of the intake air quantity regulating means. An advantage of this preferred embodiment is that an error in fault diagnosis of the fuel evaporative emission suppressing system can reliably be prevented when a running range is selected.

Preferably, the operating state detecting means detects the operating state of the engine-driven compressor for air conditioner. Also, when the operating state detecting means judges that the compressor is operating, the correcting means corrects the predetermined threshold value in a direction to decrease the same. In this preferred embodiment, when the compressor is operated during fault diagnosis and a relatively high load is applied to the engine, the predetermined threshold value is corrected by being decreased to facilitate the operation of the intake air quantity regulating means. An advantage of this preferred embodiment is that an error in fault diagnosis of the fuel evaporative emission suppressing system can reliably be prevented when the compressor is being operated.

Preferably, the operating state detecting means detects the air-fuel ratio of the mixture supplied to the engine and other operating states as at least one operating state. In this preferred embodiment, the fault diagnosis on the fuel evaporative emission suppressing means is made based on the quantity of change in air-fuel ratio of mixture, attributable to the drive of the purge regulating means, and based on the quantity of change of other operating states. In this case, when rich or lean purge air is introduced due to the drive of the purge regulating means, a significant change in air-fuel ratio of mixture is produced before and after the drive of the purge regulating means, so that the presence/absence of a fault in the fuel evaporative emission suppressing system can correctly detected on the basis of the quantity of change in air-fuel ratio. Even when purge air of substantially theoretical air-fuel ratio is introduced due to the drive of the purge regulating means and no significant change in air-fuel ratio of mixture is produced before and after the drive of the purge regulating means, fault diagnosis is properly made on the basis of the quantity of change of operating state other than the air-fuel ratio of mixture, whereby erroneous diagnosis is prevented.

BEST MODE FOR CARRYING OUT THE INVENTION

Figure 1:
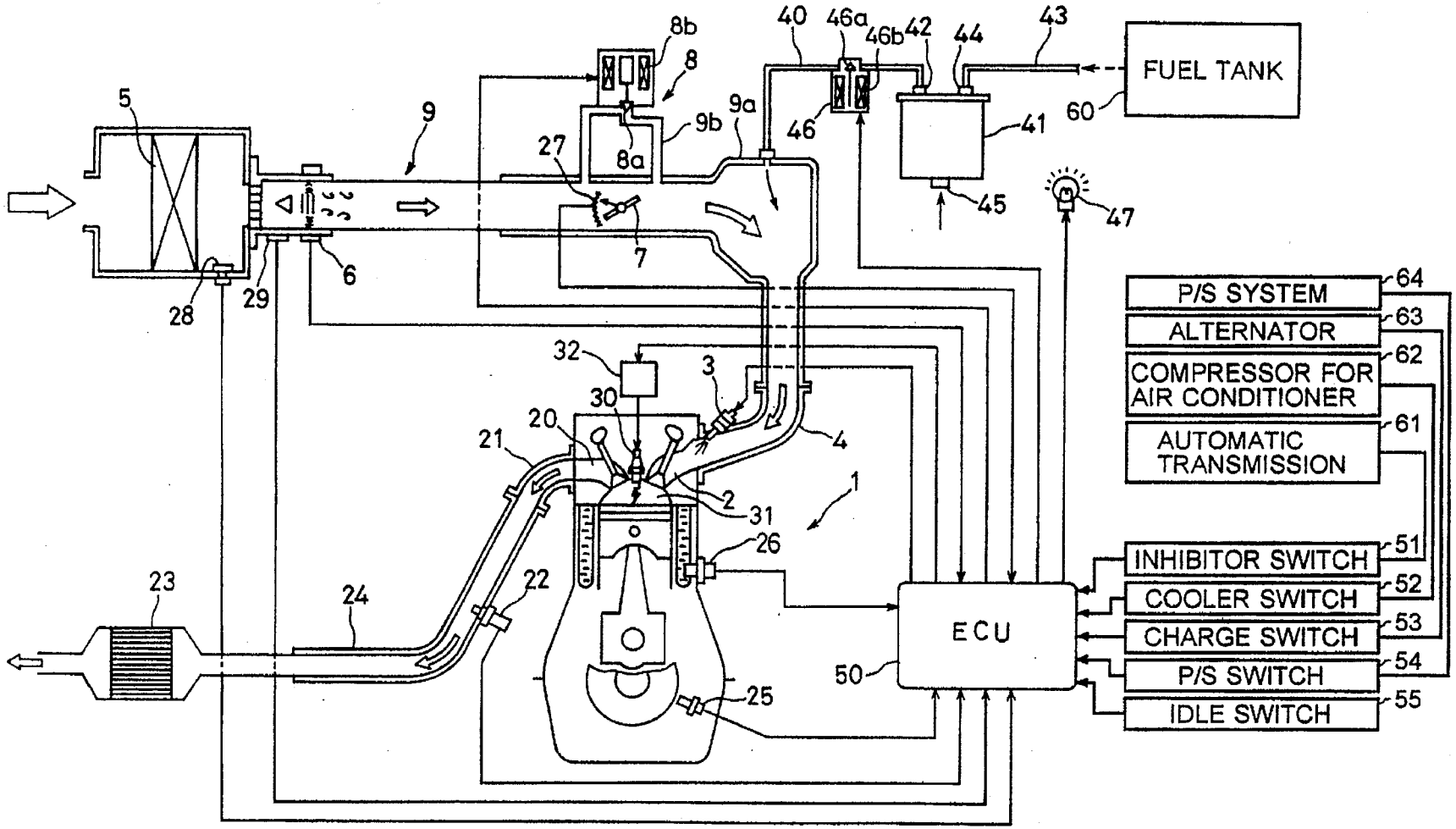
FIG. 1 is a schematic view showing an engine control system furnished with a fault diagnosis apparatus according to a first embodiment of the present invention.

Referring now to FIG. 1, a fault diagnosis apparatus according to a first embodiment of the present invention, which is provided in a fuel evaporative emission suppressing system attached to an automotive engine, will be described in detail.

In FIG. 1, reference numeral 1 denotes an automobile engine, e.g., a four-cylinder in-line gasoline engine. An intake manifold 4 is connected to an intake port 2 of the engine 1, and is provided with a fuel injection valve 3 for each cylinder. An intake pipe 9, which is connected to the intake manifold 4 through a surge tank **9*a* for intake pulsation prevention, is provided with an air cleaner 5 and a throttle valve 7. A bypass line 9*b* for bypassing the throttle valve 7 is provided with an idling speed control (ISC) valve 8 for regulating the quantity of air sucked into the engine 1 through the bypass line 9*b*. The ISC valve 8 includes a valve plug 8*a* for increasing or reducing the flow area of the bypass line 9*b* and a stepping motor 8*b* for driving the valve plug 8*a*** to cause the same to open and close.

An exhaust manifold 21 is connected to an exhaust port 20 of the engine 1, and a muffler (not shown) is connected to the manifold 21 through an exhaust pipe 24 and a three-way catalyst 23. Reference numerals 30 and 32 denote, respectively, a spark plug for igniting an air-fuel mixture fed into a combustion chamber 31 through the intake port 2 and an ignition unit connected to the plug 30.

Reference numeral 50 denotes an electronic control unit (ECU) for controlling the operation of the engine 1. The ECU 50 includes input and output devices, memories (ROM, RAM, nonvolatile RAM, etc.) storing various control programs and the like, central processing unit (CPU), timer, etc., none of which are shown in FIG. 1. Various sensors and switches, described later, are connected electrically to the input side of the ECU 50, while the stepping motor **8*b* of the ISC valve 8, a solenoid 46*b* of a control valve 46, etc. are connected electrically to the output side of the ECU 50**.

FIG. 1, also shows an airflow sensor 6 of the Karman-vortex type attached to the intake pipe 9 and used to detect the quantity of intake air; an $O_2$ sensor 22 (air-fuel ratio detecting means) for detecting the oxygen concentration of exhaust gas flowing in the exhaust pipe 24; and a crank angle sensor 25 which, including an encoder drivingly coupled with a camshaft of the engine 1, generates crank angle synchronous signals. Reference numerals 26 and 27 denote a water temperature sensor for detecting an engine cooling water temperature $T_W$ and a throttle sensor for detecting an opening θ TH of a throttle valve 7, respectively. Further, reference numerals 28 and 29 denote an atmospheric pressure sensor for detecting the atmospheric pressure Pa and an intake air temperature sensor for detecting an intake air temperature Ta, respectively.

Reference numerals 51 to 54 denote a group of switches which function as engine load detecting means. An inhibitor switch 51 is associated with a selector lever of an automatic transmission 61, and detects the gearshift range of the automatic transmission 61. A cooler switch 52 is associated with a magnet clutch of a cooler compressor of an air conditioner 62, and detects the operating state of the air conditioner 62. A charge switch 53 is associated with an alternator 63 for use as an electricity generator, and detects the state of electricity generation of the alternator 63. A P/S switch is associated with a power steering pump of a power steering (P/S) system 64, and detects the discharge pressure of hydraulic oil from the pump. Reference numeral 55 denotes an idle switch which is turned on when the throttle valve 7 is in its idle position (substantially fully closed position).

The ECU calculates an engine speed $N_E$ according to the generation time interval of the crank angle synchronous signals delivered from the crank angle sensor 25. Thus, the ECU 50, in conjunction with the crank angle sensor 25, constitutes engine speed detecting means. Also, the ECU 50 calculates an intake air quantity A/N for each intake stroke according to the calculated engine speed $N_E$ and the output of the airflow sensor 6, and detects the operating state of the engine 1 in accordance with the calculated engine speed $N_E$, calculated intake air quantity A/N, oxygen concentration of the exhaust gas detected by the $O_2$ sensor 22, operating states of auxiliary devices detected by means of the various switches, etc.

The ECU 50 controls the quantity of fuel injection from the fuel injection valve 3 into the engine 1 in accordance with the engine operating state detected in the aforesaid manner. In this fuel injection quantity control, the ECU 50 computes a valve-opening time $T_{INJ}$ of the fuel injection valve 3 according to the following equation, supplies each fuel injection valve 3 with a driving signal corresponding to the computed valve-opening time $T_{INJ}$ to cause the valve 3 to open, thereby supplying each cylinder with a required quantity of fuel.

$$T_{INJ}=T_B\times K_{AF}\times K+T_{DEAD}$$

where K is the product ($K=K_{WT}\cdot K_{AT}\cdot\ldots$) of correction factors, such as a water temperature correction factor $K_{WT}$, intake air temperature correction factor $K_{AT}$, etc.; $K_{AF}$ is an air-fuel ratio correction factor; and $T_{DEAD}$ is a dead time correction value which is set in accordance with the battery voltage and the like.

In the case where the engine 1 is operated in an air-fuel ratio feedback area, a feedback correction factor $K_{FB}$ as the air-fuel ratio correction factor $K_{AF}$ is computed as follows:

$$K_{FB}=1.0+P+I+I_{LRN}$$

where, P, I and $I_{LRN}$ are a proportional correction value, integral correction value (integral correction factor), and learning correction value, respectively.

Also, the ECU 50 controls the ignition timing of the spark plug 30 by drivingly controlling the ignition unit 32.

Further, the ECU 50, in conjunction with the ISC valve 8, constitutes intake air quantity regulating means. That is to say, during the idling operation of the engine 1, the ECU 50 calculates the deviation between the engine speed $N_E$ and a target engine speed $N_T$, and adjusts the quantity of air sucked into the engine 1 through the bypass line 9b so that the idling speed approaches the target engine speed when the deviation exceeds a threshold value ΔN (FIG. 3), that is, when the idling speed deviates from a predetermined range ($N_T-\Delta N\leqq N_E\leqq N_T+\Delta N$).

The engine 1 is furnished with a fuel evaporative emission suppressing system for preventing the emission of a fuel evaporative gas produced in a fuel tank 60 (a fuel supply system in general).

The fuel evaporative emission suppressing system has a canister 41 loaded with activated charcoal which adsorbs the fuel evaporative gas. The canister 41 is formed with a purge port 42, which communicates with the surge tank 9a of the engine 1 via a purge pipe (purge passage) 40, an inlet port 44, which communicates with the fuel tank 60 via an inlet pipe 43, and a vent port 45 which opens into the atmosphere. The purge pipe 40 is provided with a purge control valve 46 (purge regulating valve).

The control valve 46 is composed of a normally-open solenoid valve which includes a valve plug 46a for opening and closing the purge pipe 40, a spring (not shown) for urging the plug 46a in the valve closing direction, and a solenoid 46b which is connected electrically to the ECU 50. The control valve 46, which is turned on and off by means of the ECU 50, closes when its solenoid 46b is de-energized, and opens when the solenoid 46b is energized.

When the control valve 46 is opened, an intake negative pressure acts on the purge port 42, and the atmospheric air flows into the canister 41 through the vent port 45. As the atmospheric air is introduced in this manner, the fuel component of the fuel evaporative gas, having so far been adsorbed by the canister 41, leaves the canister 41, and as purge air, flows together with the atmospheric air into the surge tank 9a. When the control valve 46 is closed, on the other hand, the introduction of the purge air is prevented. In such a manner, the control valve 46, in conjunction with the ECU 50, constitutes purge regulating means for changing the quantity of the introduced purge air.

The fuel evaporative emission suppressing system is furnished with a fault diagnosis apparatus. The fault diagnosis apparatus has operating state detecting means for detecting the operating states of the vehicle and the engine 1, manipulated variable detecting means for detecting the manipulated variable of intake air quantity regulating means, fault diagnosis means for making the fault diagnosis of suppressing system, and correcting means for correcting the aforementioned threshold value ΔN in a direction to decrease the same when the engine load during fault diagnosis is high. The operating state detecting means is composed of corresponding ones of the aforementioned various sensors and switches, while the manipulated variable detecting means, fault diagnosis means, and correcting means are composed of the ECU 50.

The ECU 50 as the manipulated variable detecting means has, in the RAM thereof, a memory region for storing, in such a manner as to update, the number of driving pulses delivered from the ISC valve 8 to the stepping motor 8b. The number of stored driving pulses increases each time the driving pulse for driving the ISC valve 8 in the opening direction, and decreases each time the driving pulse for driving the ISC valve 8 in the closing direction, representing the current valve position (open position) of the ISC valve 8.

The ECU 50 as fault diagnosis means makes fault diagnosis based on the change of valve position of the ISC valve 8 (change quantity of intake air quantity regulating means) caused when the control valve 46 (purge regulating means) is operated so as to introduce purge air.

The ECU 50 as correcting means corrects the aforementioned threshold value ΔN, associated with the operation of the intake air quantity regulating means, in a direction to decrease the value ΔN, if, during the fault diagnosis, the operating state detecting means detects an operating state in which a load for increasing the quantity of intake air is applied to the engine.

In FIG. 1, reference numeral 47 denotes a warning lamp 47 mounted to an instrument panel of the vehicle for notifying a driver of the occurrence of fault of the control valve 46. The warning lamp 47 is electrically connected to the output side of the ECU 50.

Figure 2:
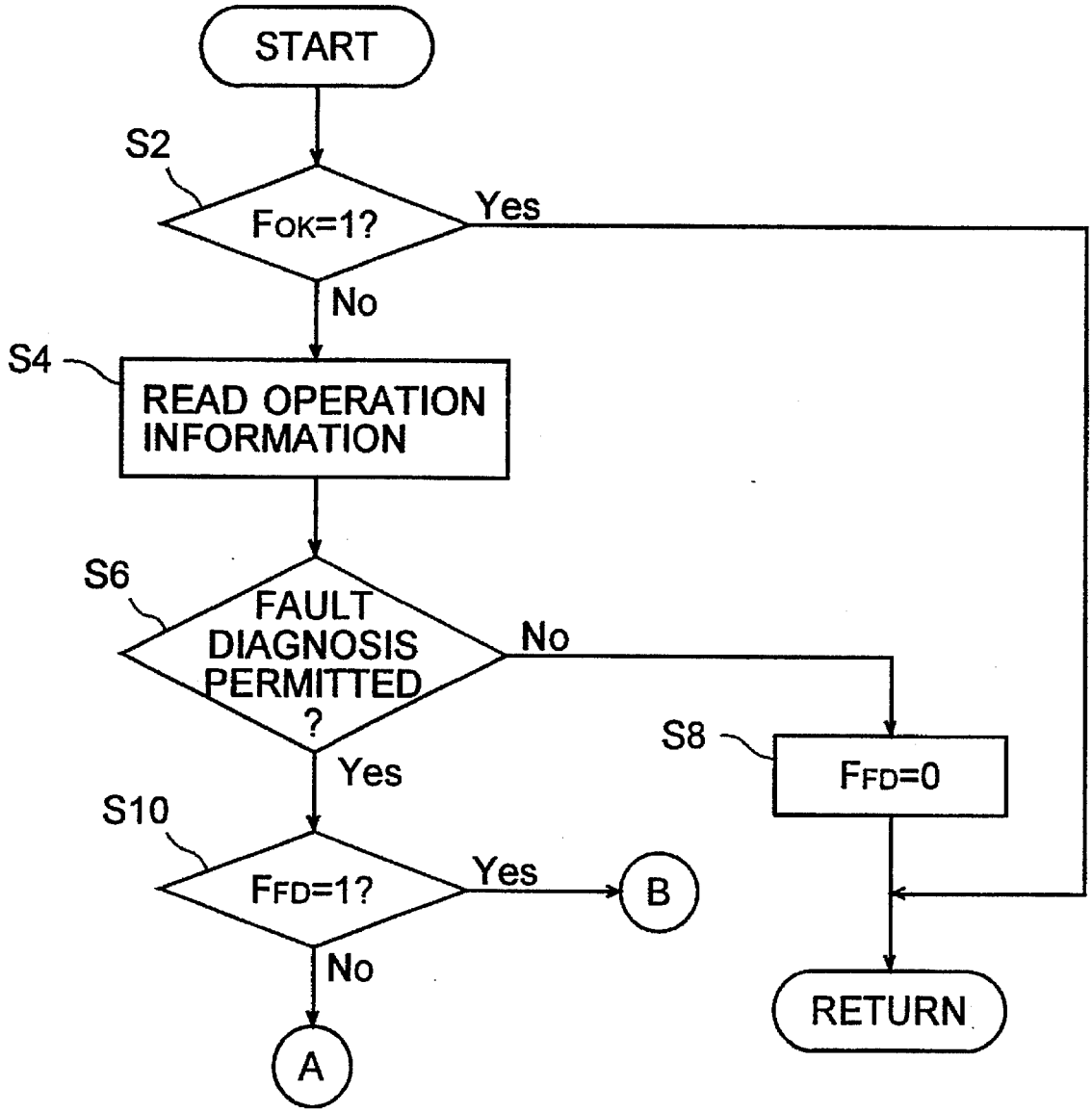
FIG. 2 is a flowchart showing part of a fault diagnosis subroutine executed by an engine control unit shown in FIG. 1.
Figure 3:
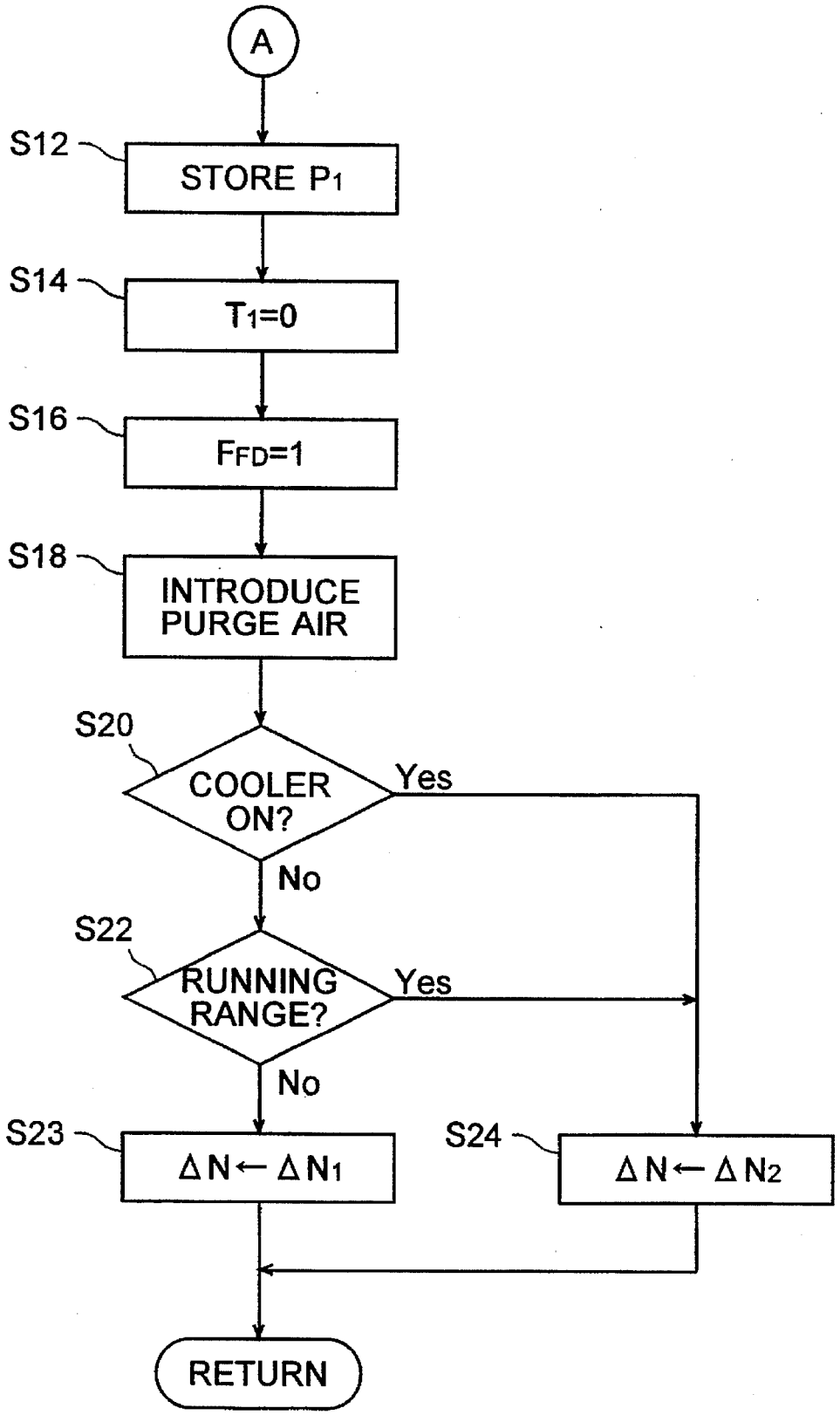
FIG. 3 is a flowchart showing a remainder of the fault diagnosis subroutine continued from FIG. 2.
Figure 4:
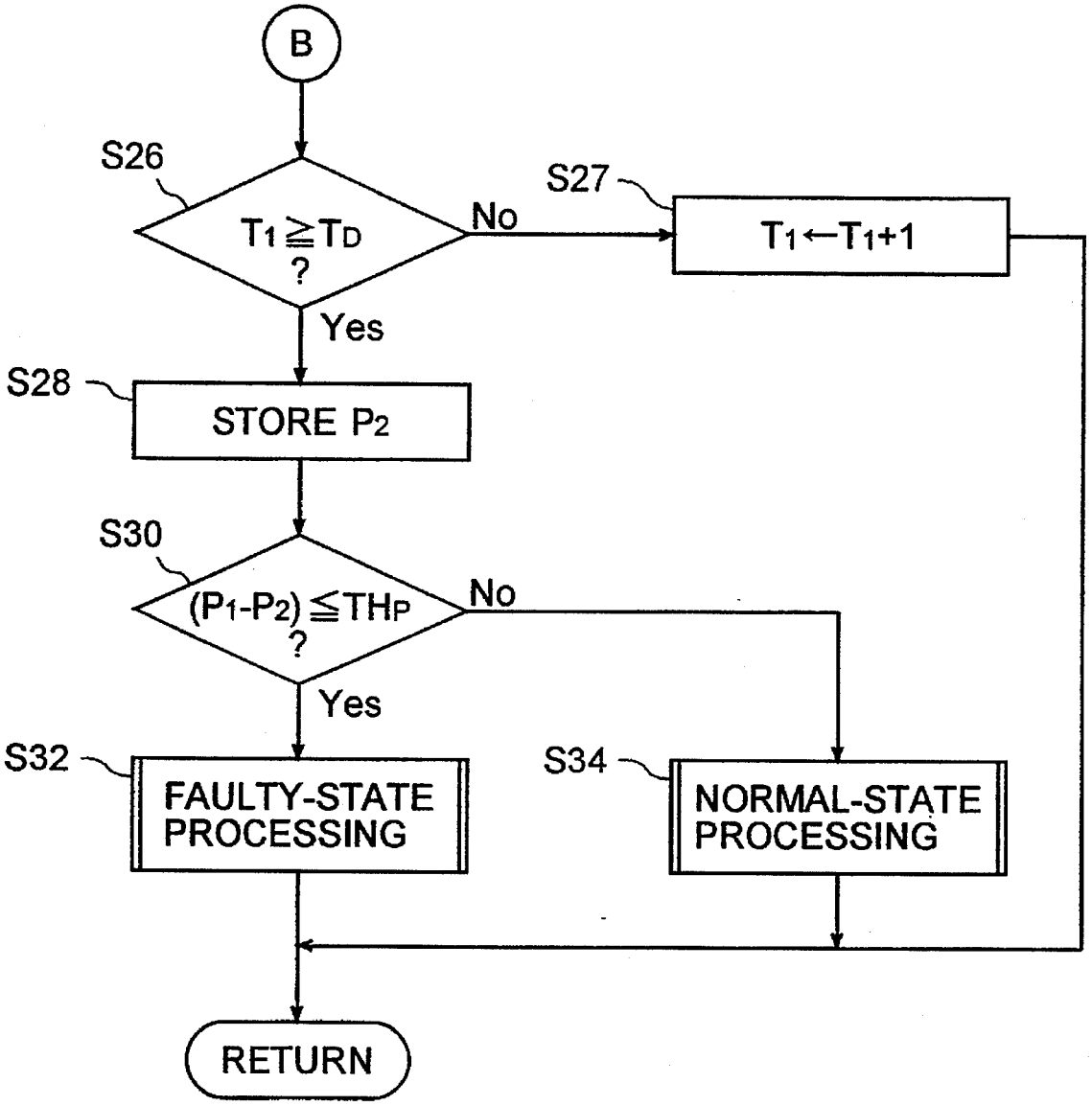
FIG. 4 is a flowchart showing a remainder of the fault diagnosis subroutine continued from FIG. 2.

Referring now to FIGS. 2 to 4, the operation of the fault diagnosis apparatus with the aforementioned construction will be described.

When the driver turns on an ignition key to start the engine 1, the ECU starts to execute the fault diagnosis subroutine shown in FIGS. 2 to 4. At the same time, a first count-up timer for measuring the time period having elapsed since the start of the engine operation is activated.

In the fault diagnosis subroutine, it is first determined whether or not the value of a flag $F_{OK}$ is "1", which is indicative of a normal operation of the purge control valve 46 (Step S2). Immediately after this subroutine is started, fault diagnosis on the control valve 46 is not executed yet, and it is unknown whether or not the valve 46 is operating normally. Immediately after the start of the subroutine, therefore, the flag $F_{OK}$ is set at an initial value "0". Thus, the decision in Step S2 in a first subroutine execution cycle (control cycle) is negative (No), whereupon the control flow advances to Step S4.

In Step S4, the count value in the first count-up timer, output of the water temperature sensor 26, output (on-off position) of the idle switch 55, etc. are read as pieces of operation information by the ECU 50 and stored in the RAM of the ECU 50.

In the next step or Step S6, it is determined whether or not fault diagnosis execution conditions are met by the current operating state. The fault diagnosis execution conditions include, for example, a first condition that a predetermined time period (e.g., 180 seconds) has passed since the start of the engine operation, a second condition that air-fuel ratio feedback control based on the output of the $O_2$ sensor 22 is started, a third condition that idling speed feedback control is being executed by the ISC valve 8, a fourth condition that the water temperature $T_W$ is not lower than a predetermined value (e.g., 82° C.), and a fifth condition that idle operation is being performed. The fault diagnosis execution conditions are considered to be fulfilled only when all of the first to fifth conditions are fulfilled simultaneously.

In the first control cycle, the decision in Step S6 is No because the predetermined time period has not elapsed yet since the start of the engine operation. In this case, it is concluded that the fault diagnosis execution conditions are not met, and the control flow advances to Step 8. In Step S8, a flag $F_{FD}$ is set at "0" which indicates that no fault diagnosis is being executed. Thereupon, the execution of the subroutine in the control cycle concerned (first cycle in this case) terminates (hereinafter referred to as "the control flow returns to Step S2").

When a time period corresponding to a subroutine execution period (predetermined period) is up, the fault diagnosis subroutine shown in FIGS. 2 to 4 are executed again starting with Step S2. Thus, the ECU 50 repeatedly executes the fault diagnosis subroutine at intervals of the predetermined period.

Unless the fault diagnosis execution conditions are met, Steps S2, S4, S6 and S8 are executed repeatedly. As this is done, the ECU 50 executes a conventional purge control subroutine (not mentioned herein) in parallel with the fault diagnosis subroutine shown in FIGS. 2 to 4. Thus, the control valve 46 is drivingly controlled as required by the ECU 50, and ordinary purge air, not purge air for fault diagnosis, is introduced, if necessary. When ordinary purge air is introduced, the threshold value ΔN in association with the operation of the ISC valve 8 is set at a relatively large first value $\Delta N_1$, by which the hunting in the operation of the ISC valve 8 caused by the increase in engine speed due to the introduction of purge air is prevented.

In the fault diagnosis subroutine, if it is concluded in Step S6 that the fault diagnosis execution conditions are met by the current operating state, it is determined whether or not the value of the flag $F_{FD}$ is "1" which indicates that the fault diagnosis is being executed (Step S10). Immediately after the fault diagnosis execution conditions are fulfilled, the value of the flag $F_{FD}$ remains at the initial value "0", so that the decision in Step S10 is No. In this case, the control flow advances to Step S12. In Step S12, the current valve position $P_V$ of the ISC valve 8 is read, and stored in the RAM as a first position $P_1$. Before the purge air introduction, the value of the valve position $P_V$ is relatively large.

In the next step or Step S14, measurement of the time period having elapsed since the start of purge air introduction is started. To attain this, a second count-up timer is activated after its count value $T_1$ is reset at "0". Then, the value of the flag $F_{FD}$ is set at "1" which indicates that the fault diagnosis is being executed (Step S16), and the purge control valve 46 is energized (Step S18). As a result, if the fuel evaporative emission suppressing system is normal, the introduction of purge air for fault diagnosis is started.

In Step S20, it is determined, based on the output (on-off position) of the cooler switch 52, whether or not a magnet clutch of cooler compressor is being engaged. If the decision is No, it is determined in Step S22, based on the output of the inhibitor switch 51, whether or not the gearshift range of the automatic transmission is a running range (R, D, 1, or 2 range). If the decision in Step 22 is No, that is, if the decisions in both of Steps 20 and 22 are No, it is concluded that the load applied currently to the engine 1 is relatively low, and therefore the quantity of intake air is also relatively small. In this case, the threshold value ΔN in association with the idling speed feedback control is set at the relatively large first value $\Delta N_1$ (Step S23). On the other hand, if the decision in Step S20 or S22 is Yes, that is, if it is concluded that a relatively high load is applied to the engine 1, the threshold value ΔN is set at a relatively small second value $\Delta N_2$ (Step S24). After the setting of the threshold value ΔN is completed in Step S23 or S24, the control flow returns to Step S2.

Since the decision in Step S10 is Yes in the next control cycle, the control flow advances to Step S26 in FIG. 4. In Step S26, it is determined whether or not a predetermined value $T_D$ which is equal to a value obtained by dividing a given delay time by the fault diagnosis subroutine execution period is attained by the count value $T_1$ in the second timer. The predetermined value $T_D$ corresponds to a period of time normally required from the time when the purge air introduction for fault diagnosis is started to the time when the change of operating state of the engine 1, attributable to the purge air introduction, is substantially settled. If the decision in Step S26 is No, "1" is added to the count value $T_1$ (Step S27), and the control flow returns to Step S2.

Thus, as long as the operating state which fulfills the fault diagnosis execution conditions lasts, a series of steps including Steps S2, S4, S6, S10, S26, and S27 is executed repeatedly, whereby the count value $T_1$ in the second timer increases gradually. If the fault diagnosis execution conditions cease to be fulfilled during the execution of a fault diagnosis, the control flow advances to Step S8, whereupon the flag $F_{FD}$ is reset at "0". In this case, the execution of the fault diagnosis is interrupted, and another fault diagnosis is started when the fault diagnosis execution conditions are fulfilled again, thereafter.

Figure 7:
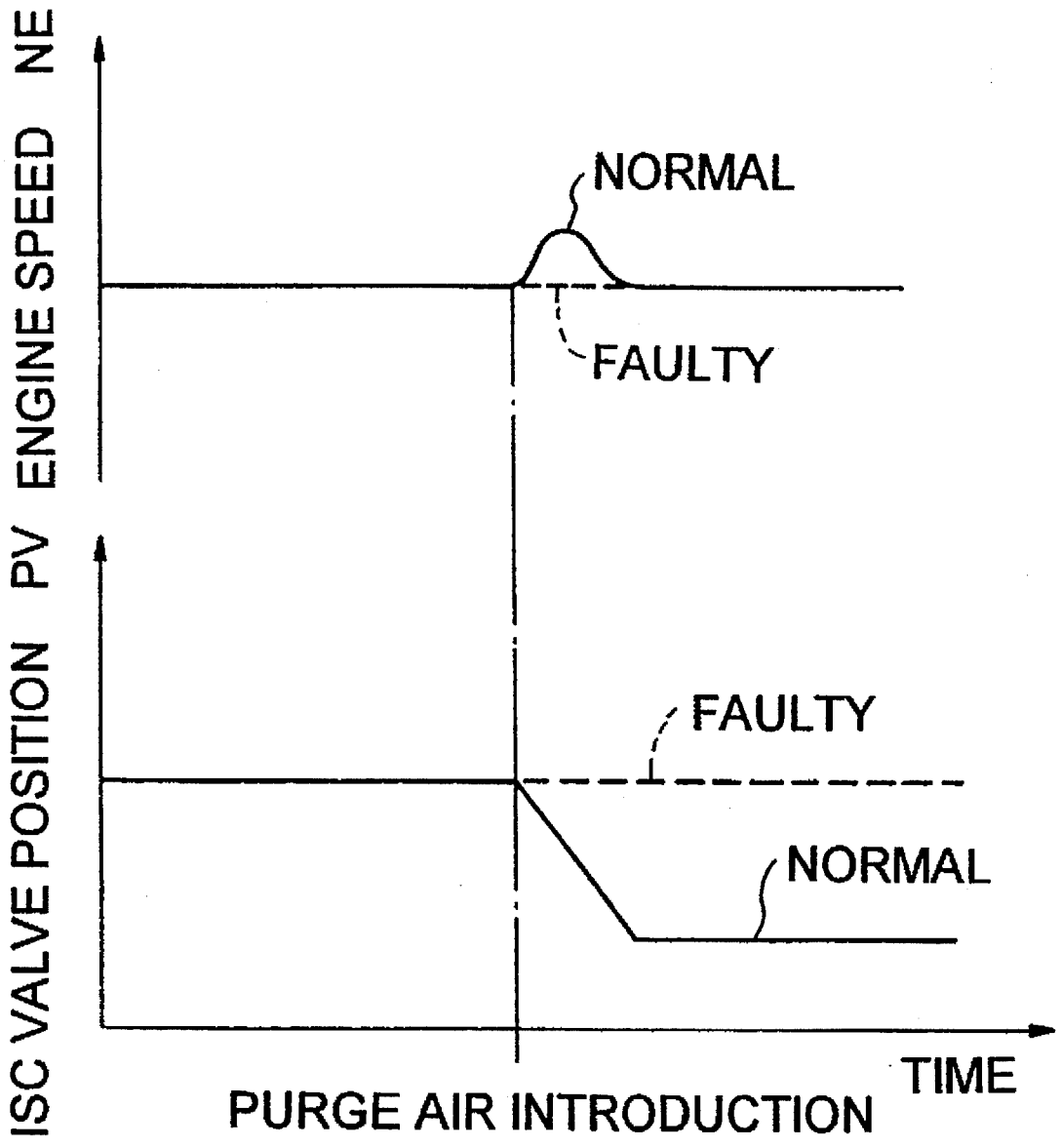
FIG. 7 is a graph showing the change of an engine speed and ISC valve position with the passage of time before and after purge air introduction.

As shown in FIG. 7, the valve position $P_V$ of the ISC valve 8 is reduced according to the quantity of the introduced purge air. If a relatively high load is applied to the engine 1 when the control valve 46 is driven (Step S18), the threshold value $\Delta N$ is set at the relatively small second value $\Delta N_2$, so that the ISC valve 8 operates sensitively, and the value of the valve position $P_V$ is reduced even if the increasing rate of total quantity of intake air due to the purge air introduction is low. The engine speed $N_E$ increases temporarily as the purge air is introduced, and thereafter, is restored to a target value by the idling speed feedback control by means of the ISC valve 8. If a fault in the purge control valve 46 prevents the purge air introduction, neither the valve position $P_V$ nor the engine speed $N_E$ changes (indicated by broken lines in FIG. 7).

In the fault diagnosis subroutine, if the attainment of the predetermined value $T_D$ by the count value $T_1$ is detected in Step S26, and hence if it is concluded that the change of the engine operating state attributable to the purge air introduction is substantially settled, the control flow advances to Step S28. In Step S28, the current valve position $P_V$ is stored as a second position $P_2$ in the RAM. Then, the deviation $(P_1-P_2)$ between the first and second positions $P_1$ and $P_2$ is calculated, and it is determined whether or not the calculated deviation (change in manipulated variable of intake air quantity regulating means) is not larger than a predetermined threshold value THp (fault discrimination value) (Step S30).

If the decision in Step S30 is Yes, that is, if no change of valve opening position of the ISC valve 8, attributable to the purge air introduction, is detected even though the purge control valve 46 is energized in Step S18, the occurrence of a fault is identified in the fuel evaporative emission suppressing system. In this case, a faulty-state processing subroutine is executed in Step S32 by the ECU 50.

Figure 5:
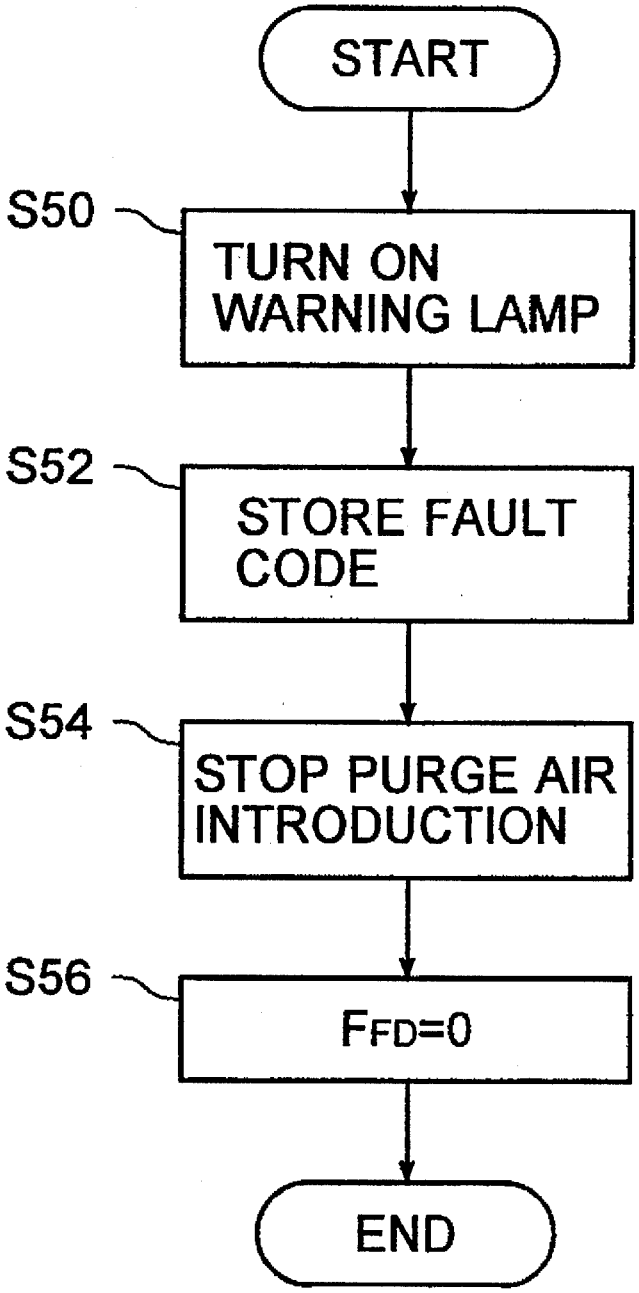
FIG. 5 is a flowchart of a faulty-state processing subroutine shown in FIG. 4.

In the faulty-state processing subroutine, as is shown in detail in FIG. 5, a warning lamp 47 is turned on in Step S50, thereby giving the driver warning. In the next step or Step S52, a fault code for diagnosis is stored in the RAM. In Step S54, the purge control valve 46 is de-energized, whereupon the purge air introduction for fault diagnosis is interrupted. Then, in Step S56, the flag $F_{FD}$ is reset at "0" which indicates that no fault diagnosis is being executed. Thereupon, the control flow returns to Step S2.

If the fault in the fuel evaporative emission suppressing system is a temporary one, the system sometimes may be restored to its normal state even after it is concluded to be faulty. In other words, the conclusion in Step S30 that the suppressing system is faulty may possibly be inappropriate. Even when the suppressing system is once concluded to be faulty, therefore, the fault diagnosis is rerun in the fault diagnosis subroutine shown in FIGS. 2 to 4.

If the change of valve opening position of the ISC valve 8, attributable to the purge air introduction for fault diagnosis, is detected, that is, if the decision in Step S30 is No, a normal-state processing subroutine is executed in Step S34 by the ECU 50.

Figure 6:
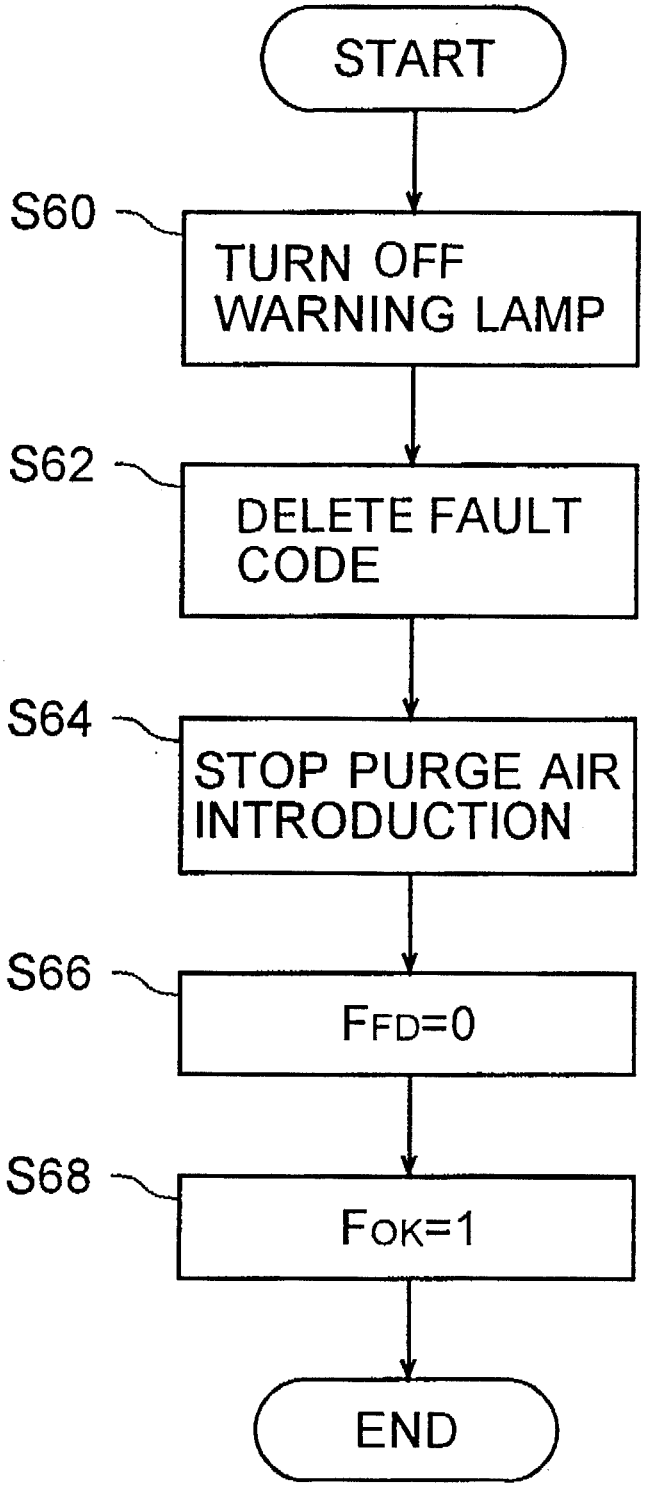
FIG. 6 is a flowchart of a normal-state processing subroutine shown in FIG. 4.

In the normal-state processing subroutine, as is shown in detail in FIG. 6, the warning lamp 47 is turned off in Step S60, and the fault code for diagnosis is deleted from the RAM in Step 62. In the next step or Step S64, the purge control valve 46 is de-energized, whereupon the purge air introduction for fault diagnosis is interrupted. Then, in Step S66, the second flag $F_{FD}$ is reset at "0" which indicates that no fault diagnosis is being executed. In Step S68, thereafter, the flag $F_{OK}$ is set at "1" which indicates that the fuel evaporative emission suppressing system is normal. Once the suppressing system is thus concluded to be normal, the decision in Step S2 in the fault diagnosis subroutine shown in FIGS. 2 to 4 is Yes, so that the execution of this subroutine terminates immediately, that is, no substantial processing is carried out. If the ignition key is turned on after it is once turned off, however, substantial processing in the fault diagnosis subroutine is executed again.

As described above, in this embodiment, if a relatively high load is applied to the engine 1 during the fault diagnosis, the threshold value $\Delta N$ in association with the ISC valve 8 is so corrected as to be decreased, whereby the insensitive zone of the ISC valve 8 is reduced, and the operation sensitivity of the ISC valve 8 is increased. As a result, even if the change in engine speed $N_E$, attributable to the purge air introduction, is small, the fault diagnosis of the fuel evaporative emission suppressing system, especially the fault diagnosis of the purge control valve 46, can be carried out accurately on the basis of the change in manipulated variable of the ISC valve 8.

The following is a description of a fault diagnosis apparatus according to a second embodiment of the present invention.

The fault diagnosis apparatus of this embodiment, characterized in that fault diagnosis is performed on the basis of the change in engine speed, has the same construction as that of the apparatus shown in FIG. 1. Therefore, the explanation of the construction of the fault diagnosis apparatus according to the second embodiment is omitted.

Next, the operation of the fault diagnosis apparatus of this embodiment will be described.

Figure 8:
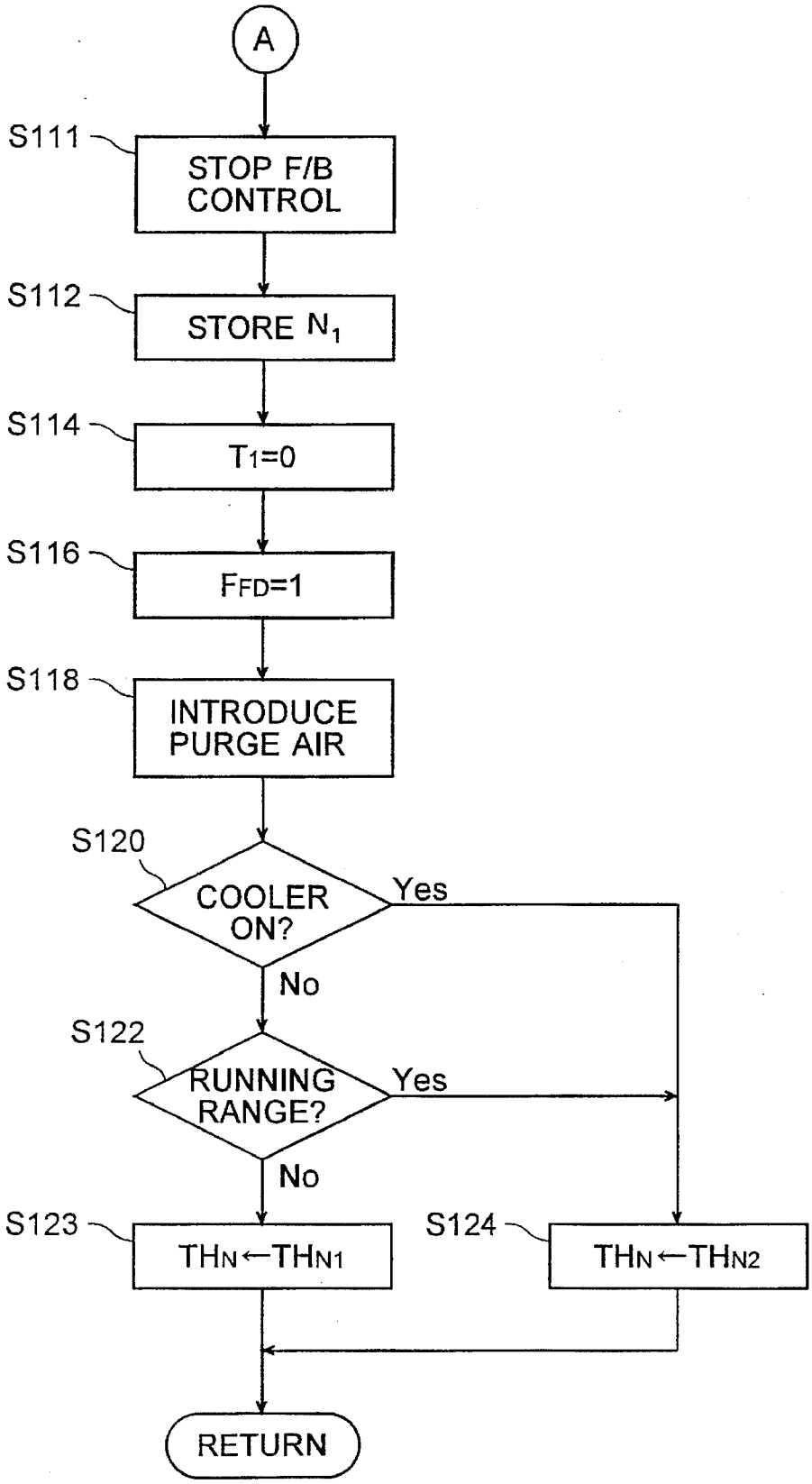
FIG. 8 is a flowchart showing part of a fault diagnosis subroutine, continued from FIG. 2, executed by a fault diagnosis apparatus according to a second embodiment of the present invention.
Figure 9:
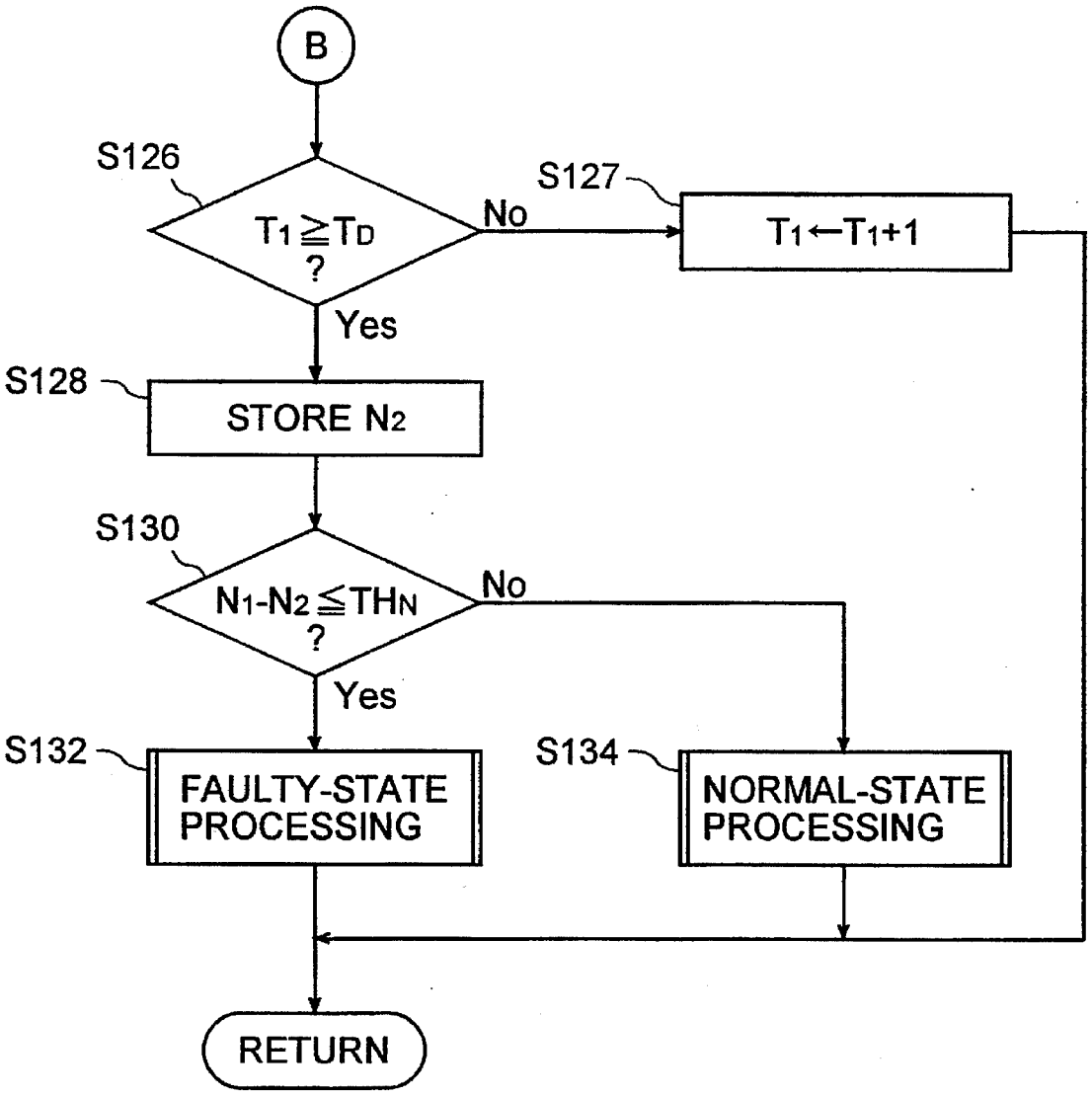
FIG. 9 is a flowchart showing a remainder of the fault diagnosis subroutine the part of which is shown in FIGS. 2 and 8.

When the engine 1 is started, the execution of the fault diagnosis subroutine including the processing shown in FIG. 2 and the processing shown in FIGS. 8 and 9 is started. At the same time, a first count-up timer for measuring the time period having elapsed since the start of engine operation is activated. The processing shown in FIG. 2 is explained briefly because it has already been explained.

In the fault diagnosis subroutine, it is first determined whether or not the value of the flag $F_{OK}$ is "1" which is indicative of a normal operation of the purge control valve 46 (Step S2). Since the decision in Step S2 in the first control cycle is No, the current operating state is read (Step S4), and it is determined whether or not fault diagnosis execution conditions are met by the current operating state (Step S6). The fault diagnosis execution conditions are the same as those of the first embodiment. The decision in Step S6 in the first control cycle is No, whereupon the value of the flag $F_{FD}$ is set at "0" which indicates that no fault diagnosis is being executed (Step S8).

If it is concluded in Step S6 that the fault diagnosis execution conditions are met by the current operating state, thereafter, it is determined whether or not the value of the flag $F_{FD}$ is "1" (Step S10). Immediately after the fault diagnosis execution conditions are fulfilled, the decision in Step S10 is No, so that the control flow advances to Step S111 in FIG. 8.

The fault diagnosis execution conditions of this embodiment are fulfilled when the engine speed feedback control is being executed by the ISC valve 8. On the other hand, in this embodiment, fault diagnosis is made on the basis of the change in engine speed. For this reason, before the execution of fault diagnosis, the engine speed feedback control must be interrupted. Thus, in Step S111, the degree of opening of the ISC valve 8 is fixed, whereby the engine speed feedback control performed by the ISC valve 8 is interrupted.

In the next step or Step S112, the current engine speed $N_E$ is read and stored in the RAM as a first speed $N_1$. Next, Steps S114, S116, S118, and S120, which correspond to Steps S14, S16, S18, and S20 shown in FIG. 3, respectively, are executed in sequence. In brief, a second count-up timer for measuring the time period having elapsed since the start of the purge air introduction is restarted (Step S114), the value of the flag $F_{FD}$ is set at "1" which indicates that the fault diagnosis is being executed (Step S116), and the purge control valve 46 is energized (Step S118). In consequence, if the fuel evaporative emission suppressing system is normal, purge air introduction for fault diagnosis is started.

In Step S120, it is determined whether or not the magnet clutch for cooler compressor is being engaged. If the decision is No, in Step S122 corresponding to Step S22 in FIG. 3, it is determined whether or not the gearshift range of automatic transmission is in a running range. If the decisions in both Steps S120 and S122 are No, it is concluded that the load applied currently to the engine 1 is relatively low, and therefore the quantity of intake air is also relatively small. In this case, the threshold value $TH_N$ used for fault diagnosis is set at a relatively large first value $TH_{N1}$ suitable for a relatively low engine load (intake air quantity) (Step S123). On the other hand, if the decision in Step S120 or S122 is Yes, that is, if it is concluded that a relatively high load is applied to the engine 1, the threshold value $TH_N$ is set at a relatively small second value $TH_{N2}$ ($<TH_{N1}$) (Step S124). If the decision in Step S120 or S122 is Yes, the degree of opening of the ISC valve 8 may be increased. After the setting of the threshold value $TH_N$ is completed in Step S123 or S124, the control flow returns to Step S2 in FIG. 3.

In the next control cycle, the decision in Step S10 is Yes, so that the control flow advances to Step S126 in FIG. 9, which corresponds to Step S26 in FIG. 3. In Step S126, it is determined whether or not the predetermined value $T_D$ is attained by the count value $T_1$. If the decision in Step S126 is No, "1" is added to the count value $T_1$ (Step S127), and the control flow returns to Step S2.

As long as the operating state which fulfills the fault diagnosis execution conditions lasts, thereafter, the count value $T_1$ in the second timer increases gradually. The engine speed $N_E$ increases when purge air is introduced, and it is unchanged when no purge air is introduced.

If it is concluded in Step S126 that the predetermined value $T_D$ is attained by the count value $T_1$, the control flow advances to Step S128. In Step S128, the current engine speed is stored in the RAM as a second speed $N_2$. Next, the deviation ($N_2$–$N_1$) between the second and first speeds $N_2$ and $N_1$ is calculated, and it is determined whether the calculated deviation is not larger than the threshold value $TH_N$ (fault discrimination value) (Step S130). This threshold value $TH_N$ is equal to the first value $TH_{N1}$ set in Step S123 or the second value $TH_{N2}$ set in Step S124, and therefore is set at a value compatible with the engine load (intake air quantity) during fault diagnosis.

If the decision in Step S130 is Yes, that is, if no change in engine speed is detected even though the purge control valve 46 is energized in Step S118, the occurrence of a fault is identified in the fuel evaporative emission suppressing system. In this case, a faulty-state processing subroutine is executed in Step S132 by the ECU 50.

Figure 10:
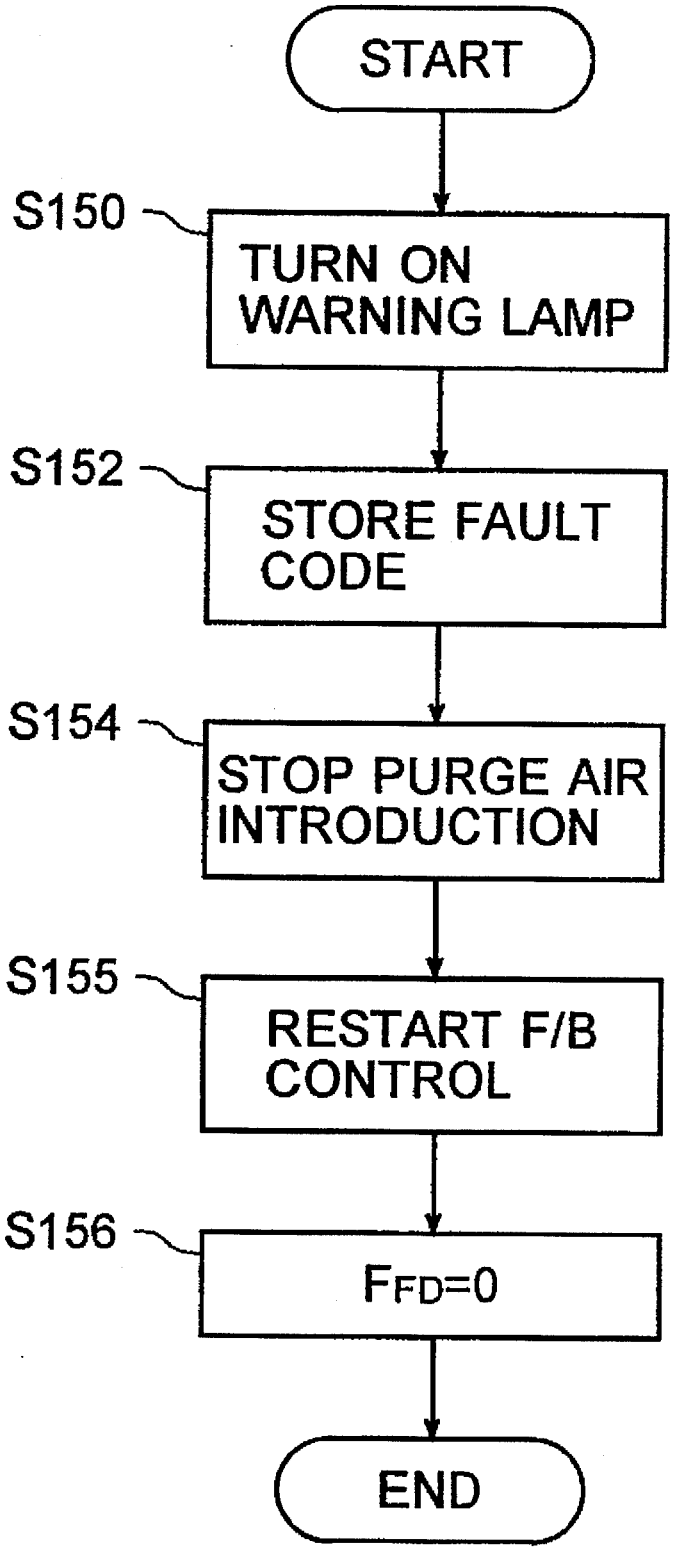
FIG. 10 is a flowchart of a faulty-state processing subroutine shown in FIG. 9.

In the faulty-state processing subroutine, as is shown in FIG. 10, like the faulty-state processing subroutine shown in FIG. 5, the warning lamp 47 is turned on (Step S150), a fault code for diagnosis is stored in the RAM (Step S152), and the purge control valve 46 is de-energized (Step S154). As described above, in this embodiment, when fault diagnosis is being executed, the engine speed feedback control by means of the ISC valve 8 is interrupted. Thus, in the faulty-state processing subroutine of this embodiment, when fault diagnosis is completed, the engine speed feedback control by means of the ISC valve 8 is restarted (Step S155). Next, the value of the flag $F_{FD}$ is reset at "0" which indicates that no fault diagnosis is being executed (Step S156). When the faulty-state processing subroutine terminates in such a manner, the control flow returns to Step S2.

If the change in engine speed, attributable to the drive of the purge control valve 46 for fault diagnosis, is detected, that is, if the decision in Step S130 is No, a normal-state processing subroutine is executed in Step S134 by the ECU 50.

Figure 11:
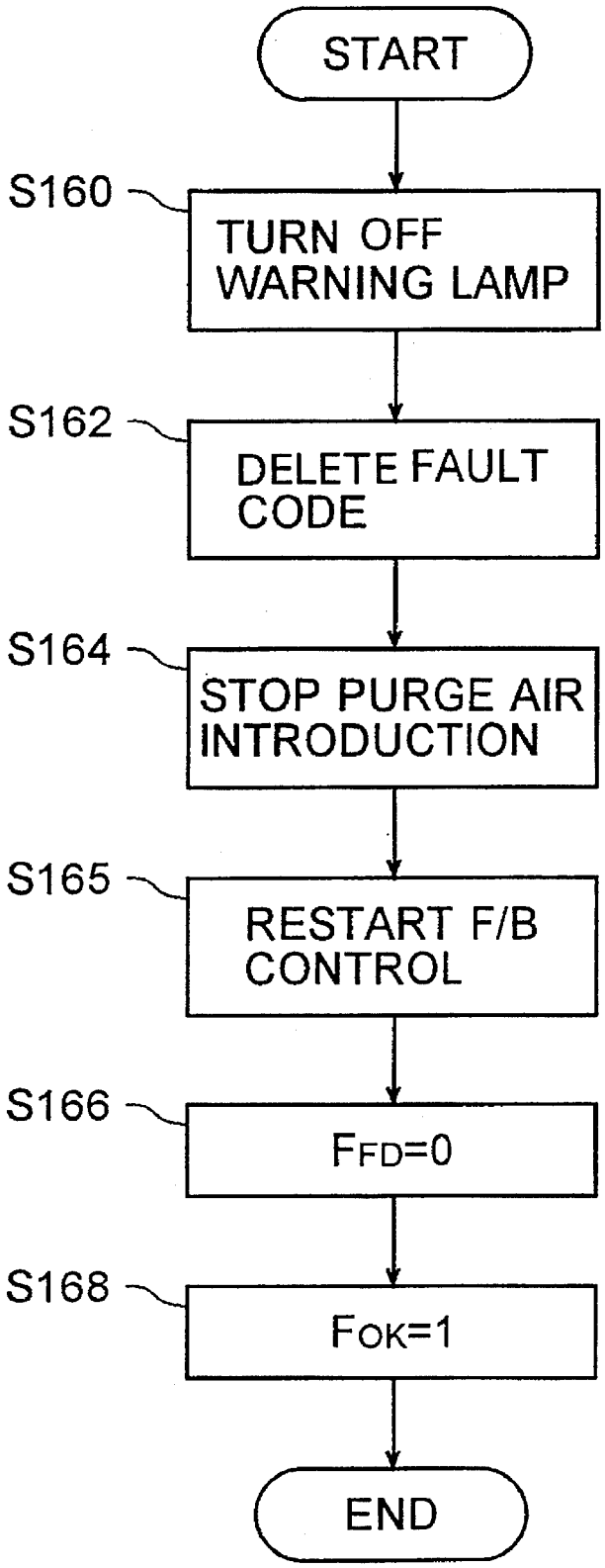
FIG. 11 is a flowchart of a normal-state processing subroutine shown in FIG. 9.

In the normal-state processing subroutine, as is shown in detail in FIG. 11, like the normal-state processing subroutine shown in FIG. 6, the warning lamp 47 is turned off (Step S160), the fault code for diagnosis is deleted from the RAM (Step 162), and the purge control valve 46 is de-energized (Step S164). Next, the engine speed feedback control by means of the ISC valve 8 is restarted (Step S165), the value of the second flag $F_{FD}$ is reset at "0" which indicates that no fault diagnosis is executed (Step S166), and the value of the flag $F_{OK}$ is set at "1" which indicates that the fuel evaporative emission suppressing system is normal (Step S168).

The following is a description of a fault diagnosis apparatus according to a third embodiment of the present invention.

The fault diagnosis apparatus of this embodiment, characterized in that fault diagnosis is made on the basis of the change in the air-fuel ratio of mixture supplied to an engine, has the same construction as that of the apparatus shown in FIG. 1. Therefore, the explanation of the construction of the fault diagnosis apparatus according to the third embodiment is omitted.

Next, the operation of the fault diagnosis apparatus of this embodiment will be described.

Figure 12:
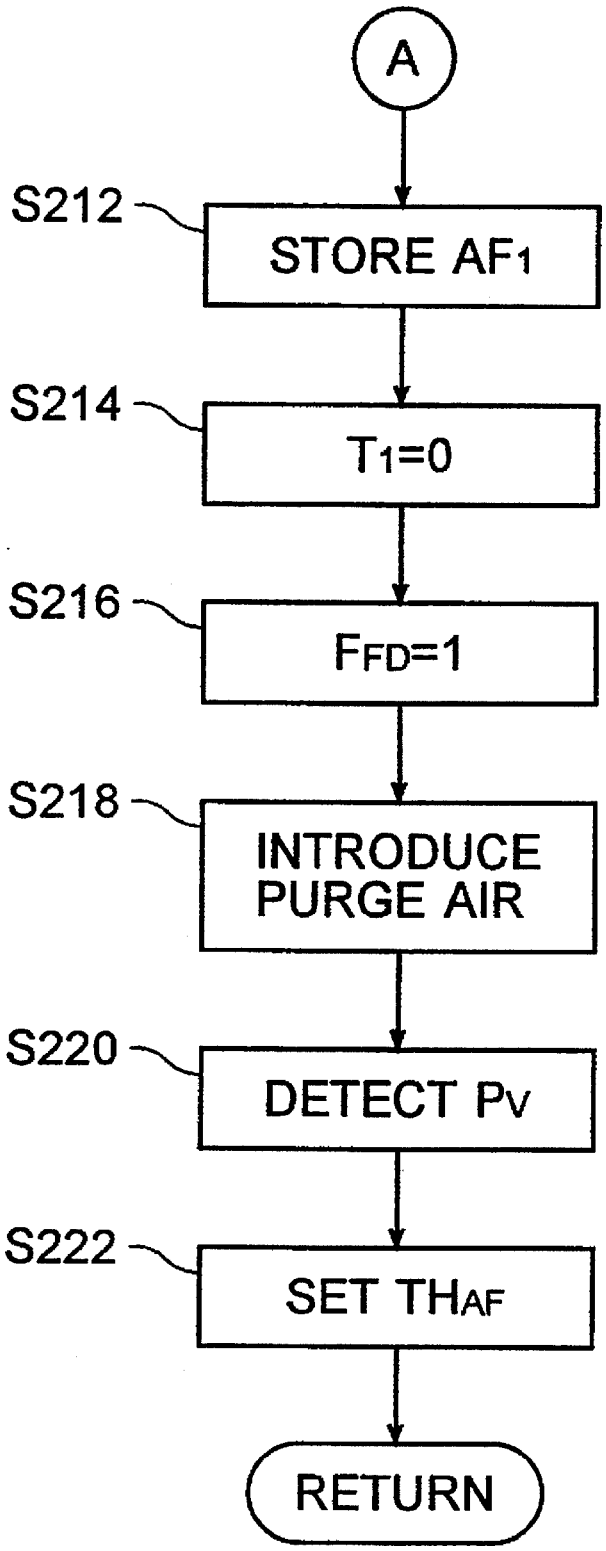
FIG. 12 is a flowchart showing part of a fault diagnosis subroutine, continued from FIG. 2, executed by a fault diagnosis apparatus according to a third embodiment of the present invention.
Figure 13:
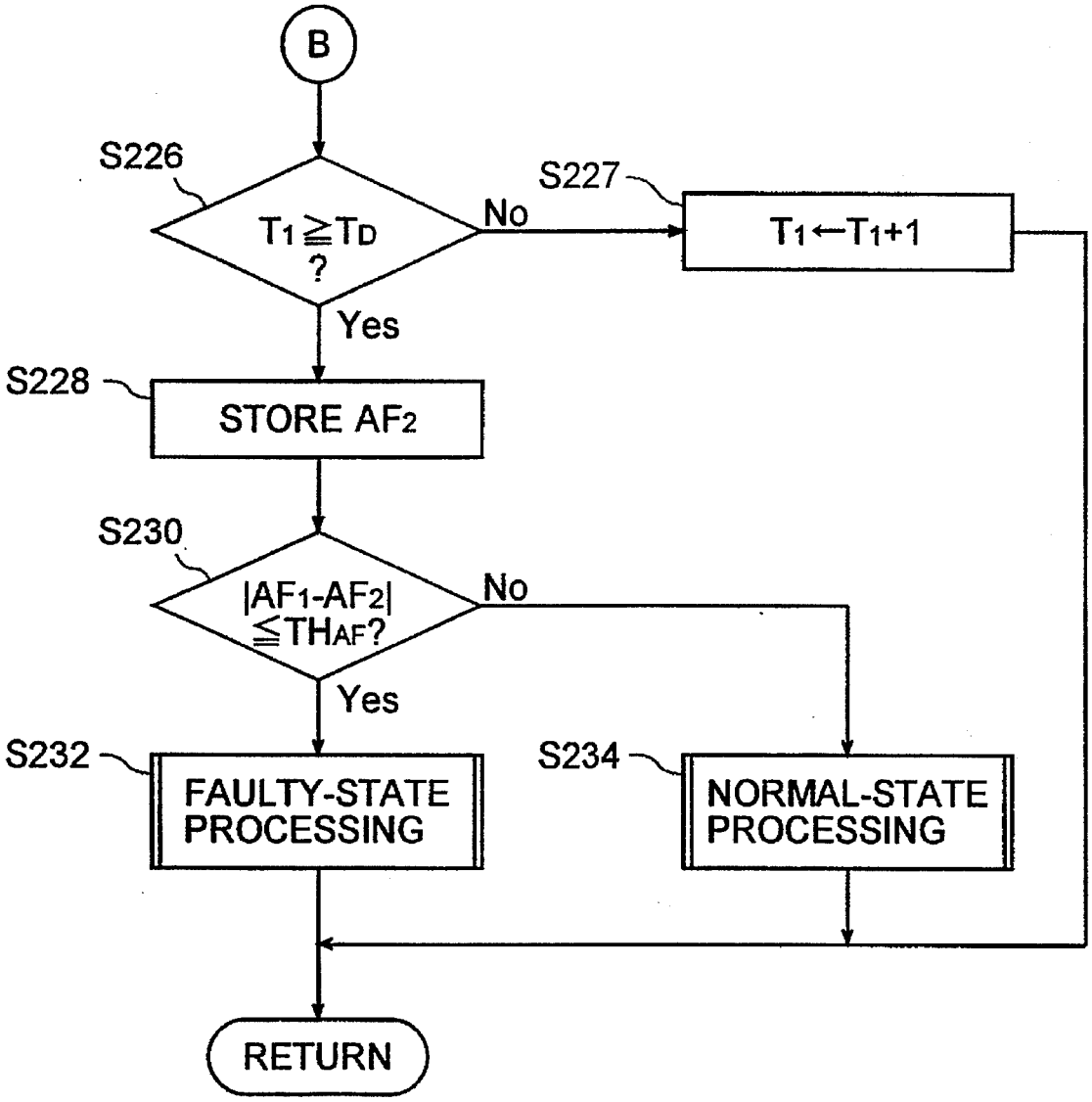
FIG. 13 is a flowchart showing a remainder of the fault diagnosis subroutine the part of which is shown in FIGS. 2 and 12.

When the engine 1 is started, the execution of the fault diagnosis subroutine including the processing shown in FIG. 2 and the processing shown in FIGS. 12 and 13 is started. Also, the measurement of the time period having elapsed since the start of engine operation is started. The processing shown in FIG. 2 is explained briefly because it has already been explained.

In the fault diagnosis subroutine, it is determined whether or not the value of the flag $F_{OK}$ is "1" (Step S2). If the decision in Step S2 is No, the current operating state is read (Step S4), and it is determined whether or not fault diagnosis execution conditions are met by the current operating state (Step S6). If the decision in Step S6 is No, the value of the flag $F_{FD}$ is set at "0" (Step S8).

Thereafter, if it is concluded in Step S6 that the fault diagnosis execution conditions are met by the current operating state, that is, if the decision in Step S6 is Yes, it is determined whether or not the value of the flag $F_{FD}$ is "1" (Step S10). If the decision in Step S10 is No, the current air-fuel ratio of mixture supplied to the engine 1 is read and stored in the RAM as a first air-fuel ratio $AF_1$ (Step S212). Next, Steps S214, S216, and S218, which correspond to Steps S114, S116, and S118 shown in FIG. 8, respectively, are executed in sequence. In brief, the second count-up timer for measuring the time period having elapsed since the start of the purge air introduction is restarted (Step S214), the value of the flag $F_{FD}$ is set at "1" (Step S216), and the purge control valve 46 is energized (Step S218). In consequence, the purge air introduction for fault diagnosis is normally started.

Next, the current valve position $P_V$ of the ISC valve 8 is detected (Step S220), a predetermined threshold value $TH_{AF}$ for fault diagnosis is set from a $TH_f$-$P_V$ map (not shown) determined by experiments and stored in the RAM in advance, on the basis of the valve position $P_V$ detected in Step S220 (Step S222), and the control flow returns to Step S2 in FIG. 3.

In the next control cycle, the decision in Step S10 is Yes, so that the control flow advances to Step S226 in FIG. 13, which corresponds to Step S126 in FIG. 9. In Step S226, it is determined whether or not the predetermined value $T_D$ is attained by the count value $T_1$ in the second timer. If the decision in Step S226 is No, "1" is added to the count value $T_1$ (Step S227), and the control flow returns to Step S2.

As long as the operating state which fulfills the fault diagnosis execution conditions lasts, thereafter, the count value $T_1$ in the second timer increases gradually. The air-fuel ratio of mixture changes when purge air is introduced, and it is unchanged when no purge air is introduced.

If it is concluded in Step S226 that the predetermined value $T_D$ is attained by the count value $T_1$, the control flow advances to Step S228. In Step S228, the current air-fuel ratio of mixture is stored in the RAM as a second air-fuel ratio $AF_2$. Next, the absolute value of deviation $|AF_1-AF_2|$ between the first and second air-fuel ratios $AF_1$ and $AF_2$ is calculated, and it is determined whether or not this absolute value is not larger than the threshold value $TH_{AF}$ (fault discrimination value), which has been set according to the quantity of intake air in Step S222 (Step S230).

If the decision in Step S230 is Yes, that is, if no change in air-fuel ratio is detected even though the purge control valve 46 is energized in Step S218, the occurrence of a fault is identified in the fuel evaporative emission suppressing system. In this case, a faulty-state processing subroutine shown in FIG. 10 is executed in Step S232. If the change in air-fuel ratio is detected, that is, if the decision in Step S230 is No, a normal-state processing subroutine shown in FIG. 11 is executed in Step S234. The faulty-state processing subroutine shown in FIG. 10 and the normal-state processing subroutine shown in FIG. 11 have already been explained; therefore, the explanation of both subroutines is omitted.

The present invention is not limited to the above-described first to third embodiments, but can be modified variously.

For example, in the first embodiment, the fault discrimination value is set variably according to two engine loads in association with the air conditioner and the automatic transmission. Alternatively, the fault discrimination value may be set according to either one of these two loads or three or more engine loads. Also, in the first embodiment, the fault diagnosis of the purge control valve is made according to only the change in manipulated variable of the ISC valve 8 before and after the drive of the purge control valve 46. Alternatively, the fault diagnosis may be made by using the control value of air-fuel ratio feedback control, the change in engine speed, etc., in addition to the change in manipulated variable of the ISC valve. Also, when purge air is introduced continuously, the purge air introduction is interrupted temporarily, and the fault diagnosis may be made on the basis of the change of the operating state at that time. Further, the specific procedure for control may be changed without departing from the spirit and scope of the present invention.

In the third embodiment, the fault diagnosis is performed on the basis of only the change in air-fuel ratio of mixture, attributable to the drive of the purge control valve 46. Alternatively, the change in engine speed or the change in manipulated variable of the ISC valve 8 during fault diagnosis may be used in addition to the change in air-fuel ratio. Thereby, erroneous diagnosis occurring when purge air of substantially theoretical air-fuel ratio is introduced in the engine by the drive of the purge control valve 46 can be prevented.

What is claimed is:

1. A fault diagnosis apparatus for detecting a fault in a fuel evaporative emission suppressing system which is attached to an engine mounted on a vehicle and which includes a purge passage, through which a fuel evaporative gas in a fuel supply system of the engine, along with outside air, is introduced as purge air into an intake passage of the engine, and purge regulating means for changing a quantity of purge air introduction, comprising:

operating state detecting means for detecting an operating state of at least one of the vehicle, the engine, and means associated with engine operation;

diagnosis means for making a diagnosis to detect occurrence of a fault in said fuel evaporative emission suppressing system, if a quantity of change of the at least one operating state is smaller than a fault discrimination value, said quantity being observed when said purge regulation means is driven to introduce the purge air; and correcting means for correcting the fault discrimination value according to the at least one operating state detected by said operating state detecting means.

2. A fault diagnosis apparatus according to claim 1, wherein said fault diagnosis apparatus is provided in the fuel evaporative emission suppressing system attached to the engine which has, in the intake passage thereof, intake air quantity regulating means for adjusting a quantity of air sucked into the engine, thereby keeping an engine speed constant and said correcting means corrects said fault discrimination value in a direction to decrease the same when an increase in manipulated variable of said intake air quantity regulating means is detected by said operating state detecting means.

3. A fault diagnosis apparatus according to claim 2, wherein said operating state detecting means detects a gearshift range of an automatic transmission mounted in the vehicle, and detects the increase in manipulated variable of said intake air quantity regulating means when the gearshift range is in a running range.

4. A fault diagnosis apparatus according to claim 2, wherein said operating state detecting means detects an operation of an engine-driven compressor for an air conditioner mounted on the vehicle, and detects the increase in manipulated variable of said intake air quantity regulating means when the compressor is operated.

5. A fault diagnosis apparatus according to any one of claims 1 to 4, wherein said operating state detecting means detects an air-fuel ratio of a mixture supplied to the engine as the at least one operating state.

6. A fault diagnosis apparatus according to claim 5, wherein said fault diagnosis apparatus is provided in the fuel evaporative emission suppressing system attached to the engine having an air-fuel ratio controlling means for feedback-controlling the air-fuel ratio to a predetermined value and said operating state detecting means detects the air-fuel ratio of mixture when the air-fuel ratio is feedback-controlled by said air-fuel ratio controlling means, as the at least one operating state.

7. A fault diagnosis apparatus according to any one of claims 1 to 4, wherein said operating state detecting means detects an engine speed as the at least one operating state.

8. A fault diagnosis apparatus according to claim 7, wherein said fault diagnosis apparatus is provided in the fuel evaporative emission suppressing system attached to the engine which has, in the intake passage thereof, intake air quantity regulating means for adjusting a quantity of air sucked into the engine, thereby keeping an engine speed constant, and prohibits the operation of said intake air quantity regulating means during fault diagnosis.

9. A fault diagnosis apparatus according to any one of claims 1 to 4, wherein said operating state detecting means detects both the air-fuel ratio of mixture and the engine speed as the at least one operating state.

10. A fault diagnosis apparatus according to any one of claims 1 to 4, wherein said fault diagnosis apparatus is provided in the fuel evaporative emission suppressing system attached to the engine which has, in the intake passage thereof, intake air quantity regulating means for adjusting a quantity of air sucked into the engine, thereby keeping an engine speed constant and said operating state detecting means detects both the air-fuel ratio of mixture and the engine speed or both the air-fuel ratio of mixture and the manipulated variable of said intake air quantity regulating means as the at least one operating state.

11. A fault diagnosis apparatus for detecting a fault in a fuel evaporative emission suppressing system attached to an engine which is mounted on a vehicle and which has an intake air quantity regulating means operating so that an engine speed approaches a target speed by regulating a quantity of air sucked in an engine via an intake passage of the engine when a deviation between the engine speed and the target speed exceeds a predetermined threshold value, the fuel evaporative emission suppressing system including a purge passage, through which a fuel evaporative gas in a fuel supply system of the engine, along with outside air, is introduced as purge air into an intake passage of the engine, and purge regulating means for changing a quantity of purge air introduction, comprising:

operating state detecting means for detecting an operation state of at least one of vehicle, the engine, and means associated with engine operation;

manipulated variable detecting means for detecting a manipulated variable of said intake air quantity regulating means;

diagnosis means for making a fault diagnosis on said fuel evaporative emission suppressing system based on a change in manipulated variable of said intake air quantity regulating means when said purge regulating means is so operated as to introduce purge air; and correcting means for correcting said predetermined threshold value in a direction to decrease the same when the operating state detecting means detects, during that time when the diagnosis means is making diagnosis, a load being applied to the engine that causes an intake air quantity to increase.

12. A fault diagnosis apparatus according to claim 11, wherein said operating state detecting means detects a gearshift range of an automatic transmission mounted on the vehicle and said correcting means corrects said predetermined threshold in a direction to decrease the same when said operating state detecting means judges that the gearshift range is in a running range.

13. A fault diagnosis apparatus according to claim 11, wherein said operating state detecting means detects an operating state of a compressor for an air conditioner, which is driven by the engine and said correcting means corrects said predetermined threshold value in a direction to decrease the same when said operating state detecting means judges that the compressor is being operated.

14. A fault diagnosis apparatus according to claim 11, wherein said operating state detecting means detects an air-fuel ratio of a mixture supplied to the engine and other operating states as the at least one operating state.

* * * * *